US006386848B2

(12) United States Patent
Nachi

(10) Patent No.: US 6,386,848 B2
(45) Date of Patent: May 14, 2002

(54) SCREW ROTORS AND SCREW MACHINE

(75) Inventor: Tsuyoshi Nachi, Mie (JP)

(73) Assignee: Teijin Seiki Co., Ltd., Tokyo (JP)

( * ) Notice: Subject to any disclaimer, the term of this patent is extended or adjusted under 35 U.S.C. 154(b) by 0 days.

(21) Appl. No.: 09/808,904

(22) Filed: Mar. 15, 2001

(30) Foreign Application Priority Data

Mar. 15, 2000 (JP) ..... 2000-072893

(51) Int. Cl.[7] ..... F03C 2/00
(52) U.S. Cl. ..... 418/201.3; 418/201.1
(58) Field of Search ..... 418/201.3, 201.1

(56) References Cited

U.S. PATENT DOCUMENTS

| | | | | | |
|---|---|---|---|---|---|
| 2,931,308 | A | * | 4/1960 | Luthi | 418/201.1 |
| 6,093,009 | A | * | 7/2000 | Jacks, Jr. | 418/201.1 |
| 6,129,535 | A | * | 10/2000 | Becher | 418/201.3 |
| 6,139,297 | A | * | 10/2000 | Becher | 418/201.1 |

FOREIGN PATENT DOCUMENTS

| | | | | |
|---|---|---|---|---|
| DE | 2005996 | * | 8/1970 | 418/201.1 |
| JP | 01-267384 | * | 10/1989 | 418/194 |
| SU | 1000598 | * | 3/1983 | 418/201.1 |

* cited by examiner

*Primary Examiner*—Thomas Denion
*Assistant Examiner*—Theresa Trieu
(74) *Attorney, Agent, or Firm*—Akin, Gump, Strauss, Hauer & Feld, L.L.P.

(57) ABSTRACT

In screw rotors (21, 22) which are each provided with a screw tooth (211, 221) having a spiral addendum surface portion (211*a,* 221*a*) and a deddendum surface portion (211*c,* 221*c*), and are used as a pair of male and female, between the addendum surface portion (211*a,* 221*a*) and deddendum surface portion (211*c,* 221*c*) of the screw tooth (211, 221), there is provided the pitch circumference portion (211*p,* 221*p*) which forms a predetermined angle range of circular arc having a definite radius rp on an optional transverse cross section, and the radius of the pitch circumference portion (211*p,* 221*p*) is set such that, when the opposing rotors are meshed with each other, out of the meshing clearances between the male and female screw teeth (211, 221), the clearance g1 between the pitch circumference portions (211*p,* 221*p*) becomes smaller than the clearances g2, g3, g4 between the other portions.

5 Claims, 7 Drawing Sheets

SCREW ROTORS AND SCREW MACHINE

BACKGROUND OF THE INVENTION

The present invention relates to the screw rotors applied to a screw machine, and to the screw machine such as a dry vacuum pump etc. using the screw rotors.

Conventionally, as a pump or a compressor which can afford a high-speed, long-time continuous operation, there is known a positive-displacement screw machine having a pair of screw rotors within its housing.

In such a kind of screw machine, e.g., the screw machine used as a dry vacuum pump, the male and female screw rotors in reverse screw relation with each other are arranged in parallel and meshed with each other so as to be spaced an infinitesimally small clearance apart, and, between the both rotors and the housing surrounding the rotors, there are formed the operation chambers comparted by the meshing portions of the rotors. Also, the screw machine is arranged such that the male and female screw rotors are rotated in synchronism, with the male and female screw rotors intermeshed in substantially a noncontact state, thus causing the volume of the operation chambers to increase on a suction side and to decrease on an exhaust side.

Also, in the vacuum pump, generally, the two phases of essential performance, i.e., the ultimate pressure and exhaust velocity thereof, are highly required. In the screw machine such as a dry vacuum pump, the meshing engagement of the male and female screw rotors arranged in parallel, as well as the clearance between the both rotors and the housing, exerts a great influence on any phases of the performance. Therefore, in such a screw machine, the clearance between the male and female screw rotors and the clearance between the both rotors and the housing are made small to the utmost, thereby seeking to improve the performance.

Further, the screw machine has some types such as a Lysholm type, a square threaded type (with a Quinby-shaped (square-shaped) tooth profile), and a spiraxial type (with a spiraxial screw tooth profile formed by combining an epitrochoid with an Archimedean spiral curve). In the Lysholm type, the one whose rotors have four threads or more each with the female rotor increased by one thread relative to the male rotor is in frequent use. In the square threaded type and the spiraxial type, the one in which the male and female rotors have one thread each is in frequent use.

In the case of the square threaded type or the spiraxial type, in the transverse cross section perpendicular to the rotation axis, the position of center of gravity thereof is heavily displaced from the rotation center. Hence, in order to strike a couple balance, it is necessary to form large cavities by means of as cast, etc., for opening cavities on the end faces of each of the screw rotors, thus causing the manufacturing process to be complex.

Further, the screw machine takes such a rotor form that, at the meshing portions of the male and female screw rotors, there occurs a difference of relative circumferential speed between the both rotors. Hence, it happens in some cases that the both screw rotors having a small clearance at the meshing portions undergo thermal expansion due to the high-speed, long-time continuous operation under a heavy load, etc., so that the both rotors are slidingly contacted, thereby causing seizure between the male and female screw rotors. Consequently, there is a problem that the meshing clearance between the rotors must be ensured even at the sacrifice of the pump performance to some extent so that such seizure between the rotors due to the thermal expansion may not occur.

SUMMARY OF THE INVENTION

Accordingly, the invention aims at reducing the meshing clearance between the screw rotors to improve the performance, and additionally an object thereof is to provide the screw machine capable of effectively preventing the seizure between the rotors even under a long-time high-speed continuous operation.

In order to solve the aforesaid problem, the invention is characterized in that, in the screw rotors which are each provided, around the rotation axis, with the screw tooth having a spiral addendum surface portion and the deddendum surface portion forming a spiral groove between the addendum surface portions, and are used as a pair of male and female in reverse screw relation with each other, between the addendum surface portion and the deddendum surface portion of the screw tooth, there is provided the pitch circumference portion which forms a predetermined angle range of circular arc having a definite radius on the optional transverse cross section perpendicular to the rotation axis.

Since the pitch circumference portion is provided, on the cross section perpendicular to the rotation axis, the position of center of gravity is never heavily displaced from the rotation center, and there is no need to form complex cavities by means of as cast, etc., thereby enabling reduction in the manufacturing costs.

In each of the screw rotors, the offset of the position of center of gravity from the rotation center becomes smaller as compared with the spiraxial type of screw rotor and the square threaded type of screw rotor both having the equivalent exhaust sectional area and rotor diameter. Hence, since the lead number is made integral to position the position of center of gravity on the rotation center axis, there is no need to form the complex cavities by means of as cast etc. for striking a couple balance.

By arranging such that the pitch circumference portion is formed in a band shape in the radial location substantially at the midpoint between the addendum surface portion and the deddendum surface portion, the tooth profiles of the respective rotors can be formed in common so as to facilitate the processing, and also the required sealing performance at the meshing portions of the screw rotors can be exerted by the pitch circumference portion having a definite width.

In the invention, it is preferable that the radius of the pitch circumference portion is set such that, when one of the pair of male and female rotors is meshed with the opposing rotor, of the meshing clearances between the male and female screw teeth, the clearance between the pitch circumference portions is smaller than the clearances between the other portions. In this case, when the male and female screw rotors are meshed with each other, of the meshing clearances between the male and female screw teeth, the clearance between the pitch circumference portions is smaller than the clearances between the other portions. Hence, the meshing clearance between the rotors becomes the smallest between the pitch circumference portions. Thereby, however, when the screw rotors undergo thermal expansion, the pitch circumference portions with a definite radius are initially abutted against each other into a rolling contact, and thus seizure is difficult to occur as compared with the conventional machine in which the tooth portions of the both rotors are most apt to be slidingly contacted.

Further, since the meshing clearance per se between the rotors can be maintained the smallest between the pitch circumference portions, the efficiency can be increased.

The screw machine according to the invention is characterized in that, with the screw rotors arranged as the male and female rotors meshed with each other, the both rotors are housed in parallel within the housing forming a suction port and an exhaust port, so as to be meshed with each other in a noncontact meshing engagement, and that, between the housing and the both rotors, there are formed a plurality of operation chambers which are transferred in the axial direction of the rotation axis by rotation of the screw rotors, and have volume increased in the transfer section communicating with the suction port, while decreased in the transfer section communicating with the exhaust port.

The present disclosure relates to the subject matter contained in Japanese patent application No. 2000-72893 (filed on Mar. 15, 2000), which is expressly incorporated herein by reference in its entirety.

BRIEF DESCRIPTION OF THE DRAWINGS

FIG. 6(*a*) is a transverse sectional view of the screw rotor of an embodiment thereof, FIG. 6(*b*) a transverse sectional view of a spiraxial type of rotor as a comparative example, and FIG. 6(*c*) a transverse sectional view of a square threaded type of rotor as another comparative example.

FIG. 8(*a*) is a left side view thereof, and FIG. 8(*b*) a right side view thereof.

DESCRIPTION OF THE PREFERRED EMBODIMENT

Figure 1:
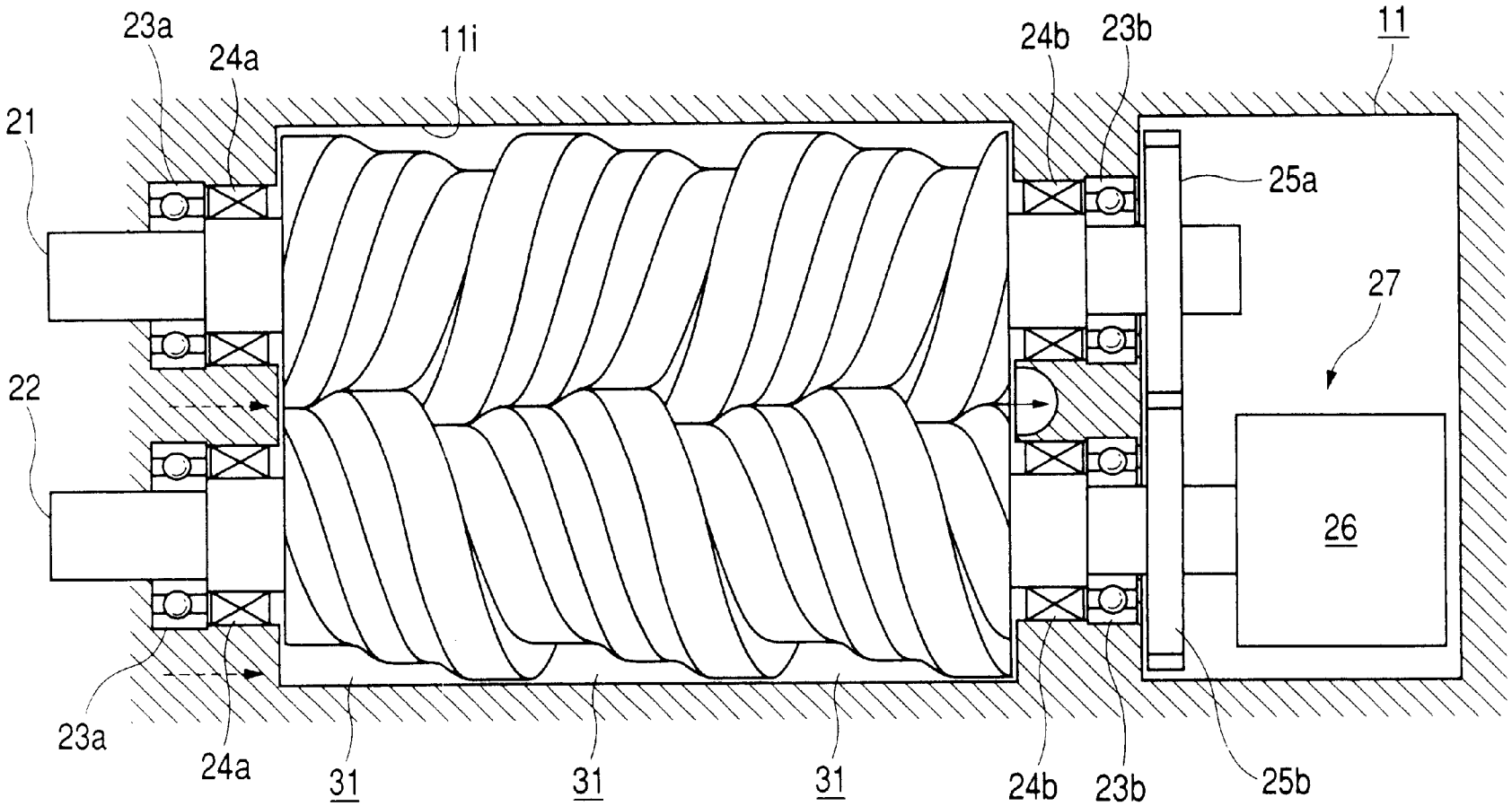
FIG. 1 is a front sectional view of main portions showing the schematic internal structure of the screw machine according to an embodiment of the invention.

A preferred embodiment of the invention will be explained below based on the drawings.

FIGS. 1 to 6 are the views illustrating the screw rotors and screw machine according to an embodiment of the invention.

The screw machine of the embodiment, an application of the invention to a dry vacuum pump, includes the housing 11 forming a suction port 11*a* and an exhaust port 11*b*, the male and female screw rotors 21, 22 housed within the housing 11 in parallel so as to be meshed with each other in a noncontact meshing engagement with a predetermined clearance (an infinitesimally small clearance), the bearings 23*a*, 23*b* and the sealing members 24*a*, 24*b* for sealing the bearing bores, which are both mounted between the housing 11 and the screw rotors 21, 22, the driving means 27 which has synchronous gears 25*a*, 25*b* integrally mounted on the screw rotors 21, 22 so as to synchronously rotate the respective rotors 21, 22 in reverse directions, and the motor 26 coupled to one end of the rotor 22.

The female side screw rotor 21 and the male side screw rotor 22 are of external diameter and axial length such as to be spaced a predetermined clearance, e.g., a clearance of 50 μm with respect to the inner wall surface 11*i* of the housing 11. Between the housing 11 and the both screw rotors, there are formed a plurality of spiral operation chambers 31, which are comparted one from another at the meshing portions of the screw rotors 21, 22, and transferred in the axial direction of the rotation axis by rotation of the screw rotors 21, 22.

Figure 2:
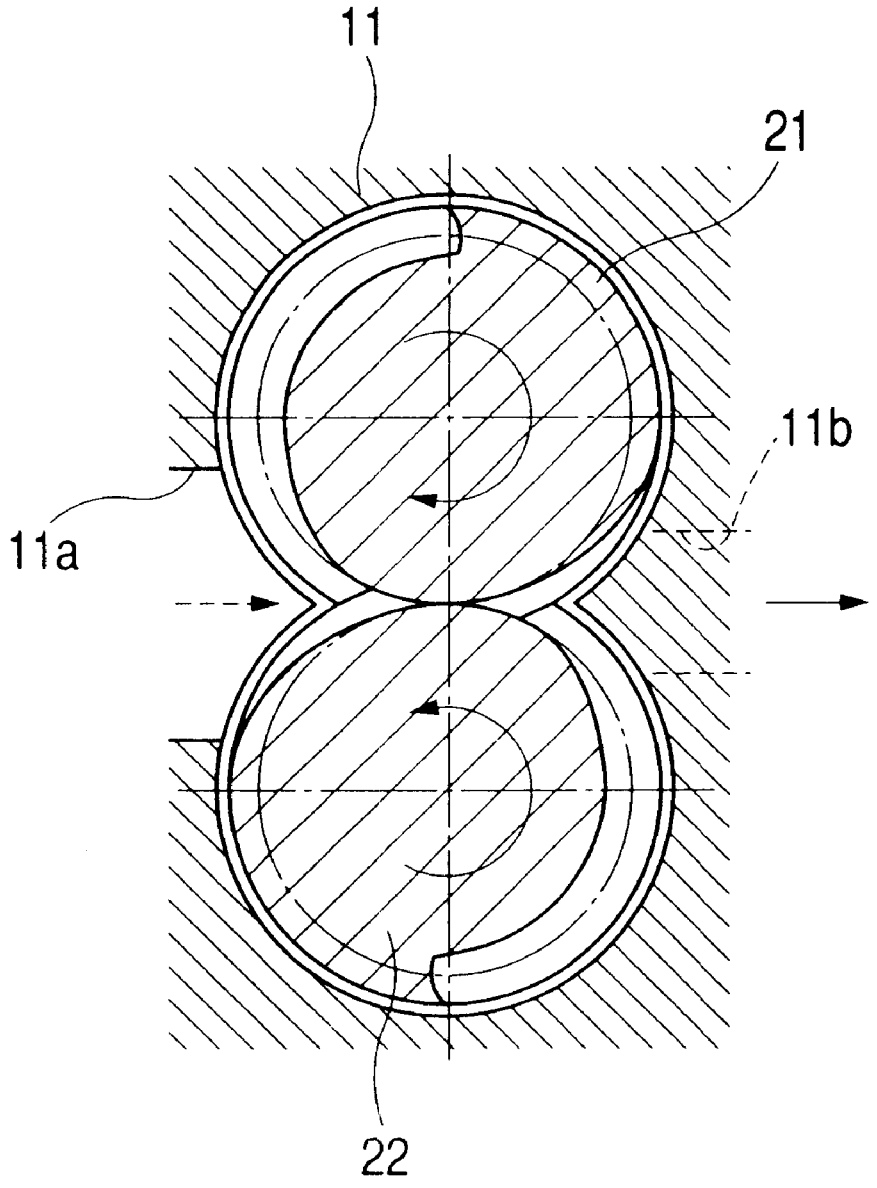
FIG. 2 is a transverse sectional view of the vicinity of the screw rotors of the screw machine according to an embodiment of the invention.

As the screw rotors 21, 22 rotate, the operation chambers 31 have the volume increased in the transfer section on the left end side as seen in FIG. 1. While the volume is increased, as shown in FIG. 2, the operation chambers communicate with the suction port 11*a* of the housing 11, and are transferred to the right side as seen in FIG. 1 after the completion of suction. Thereafter, the operation chambers have the volume decreased in the transfer section on the right end side as seen in FIG. 1. In the area of the completion of compression where the volume of the operation chambers 31 falls below a predetermined value, the operation chambers 31 on the right end side as seen in FIG. 1 communicate with the exhaust port 11*b* so as to be exhausted.

Figure 3:
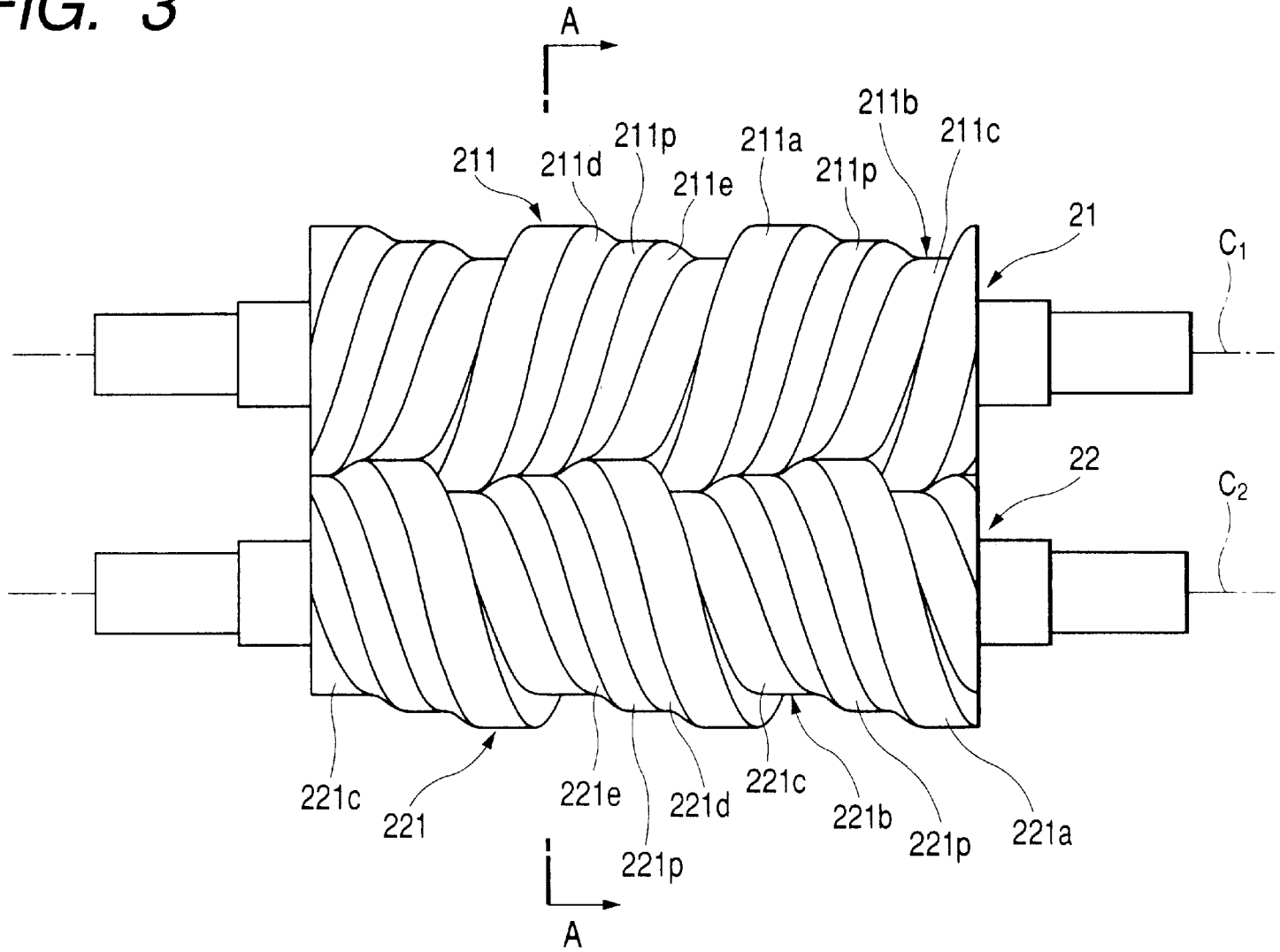
FIG. 3 is a front view showing the meshing relation between the male and female screw rotors according to an embodiment of the invention.
Figure 4:
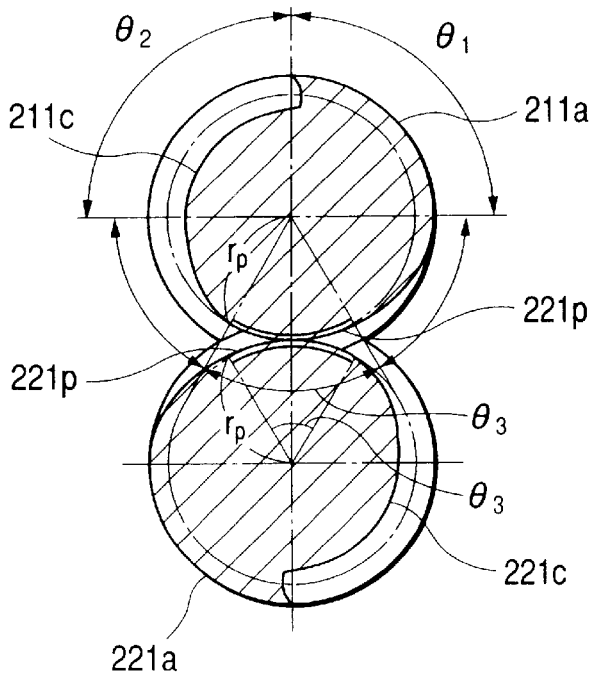
FIG. 4 is a section view taken on line A—A of FIG. 3.

Specifically, as shown in FIGS. 3 and 4, the screw rotor 21 is provided with the spiral screw tooth 211 around the rotation axis C1. The screw tooth 211 has the spiral band-shaped addendum surface portion 211*a* and the deddendum surface portion 211*c* forming the spiral groove with a predetermined groove width 211*b* between the addendum surface portions 211*a*. Also, between the addendum surface portion 211*a* and deddendum surface portion 211*c* of the screw tooth 211, there are provided the pitch circumference portion 221*p*, the addendum-side inclined face 211*d* toward the addendum surface portion 211*a* relative to the pitch circumference portion 211*p*, and the deddendum-side inclined face 211*e* toward the deddendum surface portion 211*c* relative to the pitch circumference portion 211*p*.

On the other hand, the screw rotor 22 is provided with the spiral screw tooth 221 around the rotation axis C2 so as to be in reverse screw relation with the screw rotor 21. The screw tooth 221 has the spiral band-shaped addendum surface portion 221*a* and the deddendum surface portion 221*c* forming the spiral groove with a predetermined groove width 221*b* between the addendum surface portions 221*a*. Also, between the addendum surface portion 221*a* and deddendum surface portion 221*c* of the screw tooth 221, there are provided the pitch circumference portion 221*p*, the addendum-side inclined face 221*d* toward the addendum surface portion 221*a* relative to the pitch circumference portion 221*p*, and the deddendum-side inclined face 221*e* toward the deddendum surface portion 221*c* relative to the pitch circumference portion 221*p*.

Figure 5:
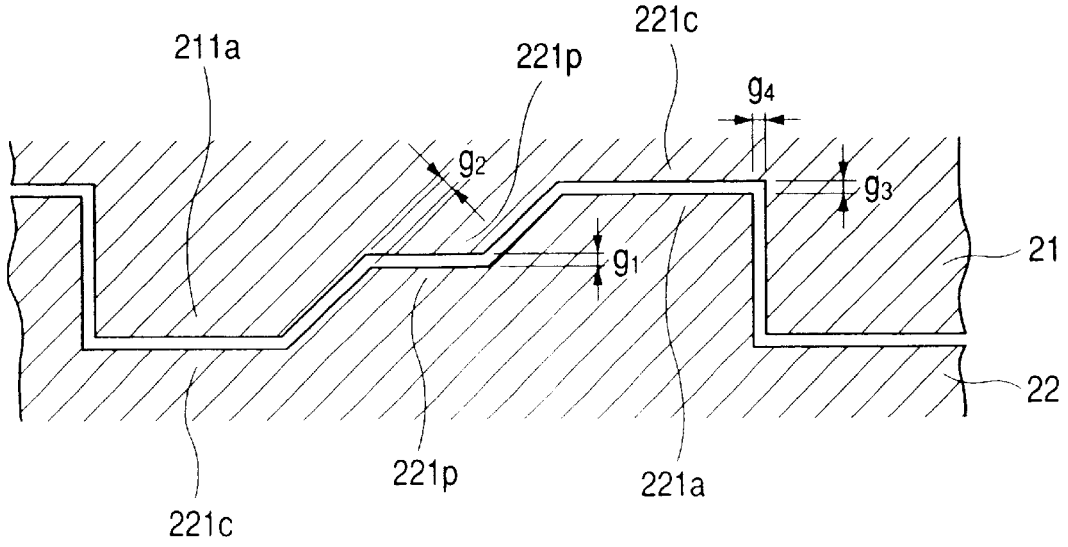
FIG. 5 is a type section view of the meshing portions showing the setting state of the meshing clearances between the male and female screw rotors according to an embodiment of the invention.

The pitch circumference portions 211*p*, 221*p* of the screw rotors 21, 22, as shown in FIG. 4, on the cross section (transverse cross section) perpendicular to the rotation axes C1, C2, each have a definite radius rp (an identical radius to each other) equivalent to substantially ½ the center distance between the rotation axes C1, C2 (a radius smaller by ½ the infinitesimally small clearance g1 than ½ the center distance), and also are each shaped as a curved surface of spiral band shape so as to form the circular arc of a predetermined angle range, i.e., an identical angle range θ3 to each other. The pitch circumference portions 211*p*, 221*p*, in the longitudinal section of the respective screw rotors 21, 22, as shown in FIG. 5, each have a flat contour substantially parallel to the addendum surface portion 221*a* and the deddendum surface portion 221*c*, and form a stepped tooth profile along with the addendum-side inclined face 221*d* and the deddendum-side inclined face 221*e*. Further, similarly to the angle range of the pitch circumference portions 211*p*, 221*p*, the angle range of the addendum surface portion 221*a* of the rotor 22 in FIG. 4 is identical to the angle range θ1 of the addendum surface portion 211*a* on the transverse cross section of the rotor 21, and the angle range of the deddendum surface portion 221*c* of the rotor 22 is identical to the angle range θ2 of the deddendum surface portion 211*c* on the transverse cross section of the rotor 21. The angle ranges θ1, θ2, θ3 may be set to any value, and the angle range θ3 of the pitch circumference portions 211*p*, 221*p* may be set to a value, e.g., within the range of $5° \leqq \theta 3 < 180°$.

Also, the respective connecting shapes are set in a manner that the connecting portions between the addendum surface portions 211*a*, 221*a* and the pitch circumference portions 211*p*, 221*p* of the respective screw rotors 21, 22 are shaped in connecting curves, e.g., of a circularly arcuate shape, connected smoothly on the transverse cross sections of the respective rotors 21, 22, the connecting portions between the pitch circumference portions 211*p*, 221*p* and the deddendum surface portions 211*c*, 221*c* of the respective screw rotors 21, 22 are shaped in generating curves obtained from the connecting curves so as to be connected smoothly on the transverse cross sectins of the respective rotors 21, 22, and the connecting portions between the addendum surface portions 211*a*, 221*a* and the deddendum surface portions 211*c*, 221*c* of the respective screw rotors 21, 22 are shaped in trochoid curves which are subscribed by the tooth tops (one side end of each of the addendum surface portions 221*a*, 211*a*) of the respective opposing screw rotors 22, 21.

Further, as shown in FIG. 5, in the screw rotors 21, 22, the radii of the pitch circumference portions 211*p*, 221*p* and the screw tooth profiles (the screw tooth profiles in the longitudinal sections of the respective rotors) can be set such that, when the opposing rotors whose male and female are opposite to each other are put in meshing engagement, out of the meshing clearances between the male and female screw teeth 211, 221, the clearance g1 between the pitch circumference portions 211*p*, 221*p* (the clearance between the opposite surfaces, e.g., 20 μm) becomes smaller than the clearances g2, g3, g4, etc. between the other meshing portions (the clearances between the opposite surfaces, e.g., 50 μm each).

Figure 6A:
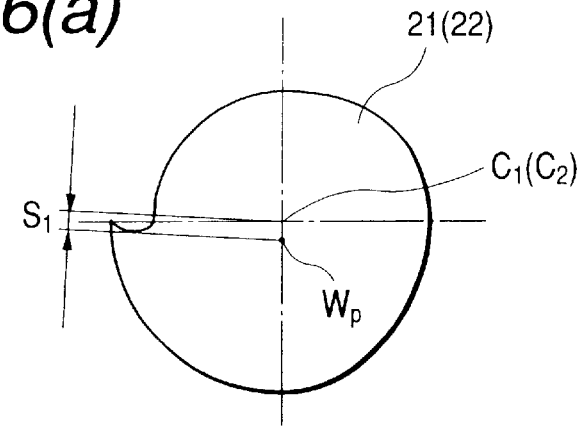
FIGS. 6(*a*) to 6(*c*) are views each illustrating the position of center of gravity on the transverse section of each of the screw rotors according to an embodiment of the invention.
Figure 6B:
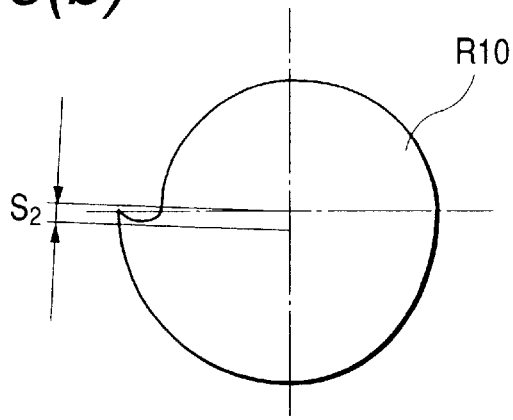
Figure 6C:
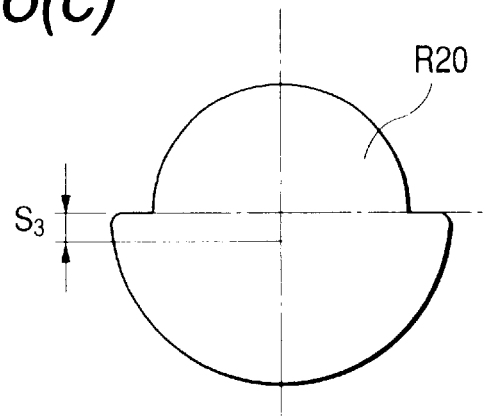

Furthermore, as shown in FIG. 6(*a*), in each of the screw rotors 21, 22, on the section perpendicular to the rotation axis C1, C2, the position of center of gravity wp is eccentric by a predetermined offset S1 away from the rotation center C1, C2. The offset S1 (e.g., 4.487 mm) becomes smaller, as compared with the offset S2 (e.g., 4.938 mm in the case of having the exhaust sectional area and rotor radius equivalent to that of each of the rotors 21, 22) in a spiraxial type of screw rotor R10 as shown in FIG. 6(*b*), or as compared with the offset S3 (e.g., 6.032 mm in the case of having the exhaust sectional area and rotor radius equivalent to that of each of the rotors 21, 22) in a square threaded type of screw rotor R20 as shown in FIG. 6(*c*). (The larger the angle range θ3 of the pitch circumference portion 211*p*, 221*p* becomes, the offset S1 can be made relatively smaller.) However, in order that the position of center of gravity as a whole is positioned on the rotation center axis line, the screw rotors 21, 22 of the embodiment are each arranged to have the screw lengths in which the lead number thereof is made integral (e.g., 3), i.e., the multiple screw lengths of the lead.

The operation will now be explained.

In the screw machine of the embodiment arranged as described above, at the start time of or during normal operation, the male and female screw rotors 21, 22 are meshed with each other in a noncontact meshing engagement with an infinitesimally small clearance spaced apart. At this time, out of the meshing clearances between the male and female screw teeth 211, 221, the clearance g1 between the pitch circumference portions 211*p*, 221*p* becomes smaller than the clearances g2, g3, g4, etc. of the other respective meshing portions. Hence, the meshing clearance between the rotors 21, 22 becomes the smallest between the pitch circumference portions 211*p*, 221*p*. Thereby, however, when the screw rotors 21, 22 undergo thermal expansion due to a high-speed, long-time continuous operation, etc., the pitch circumference portions 21, 22 with a definite radius are initially abutted against each other into a rolling contact, and thus seizure is difficult to occur as compared with the conventional screw machine in which the tooth portions 211, 221 of the both rotors 21, 22 are most apt to be slidingly contacted with each other. Therefore, there is not such a problem that, as has been conventional, the clearance is unnecessarily extended in order to prevent seizure, thereby sacrificing the performance of pump and compressor. Accordingly, it is possible to provide the screw machine of a higher performance.

Also, in each of the screw rotors 21, 22, the offset of the position of center of gravity from the rotation center C1, C2 becomes smaller as compared with the spiraxial type of screw rotor R10 and the square threaded type of screw rotor R20 both having the equivalent exhaust sectional area and rotor diameter. Hence, since the lead number is made integral to position the position of center of gravity on the rotation center axis, there is no need to form the complex cavities by means of as cast etc. for striking a couple balance. Accordingly, it is possible to reduce the processing manpower to such an extent as to form simple shallow concave portions.

Further, the pitch circumference portion 211*p*, 221*p* is formed in a band shape in the radial location substantially at the midpoint between the addendum surface portion 211*a*, 221*a* and the deddendum surface portion 211*c*, 221*c*. Hence, the tooth profiles of the rotors 21, 22 can be formed in common so as to facilitate the processing, and also the required sealing performance at the meshing portions of the screw rotors 21, 22 (between the adjacent operation chambers 31) can be exerted by the pitch circumference portions 211*p*, 221*p* having a definite width.

Figure 7:
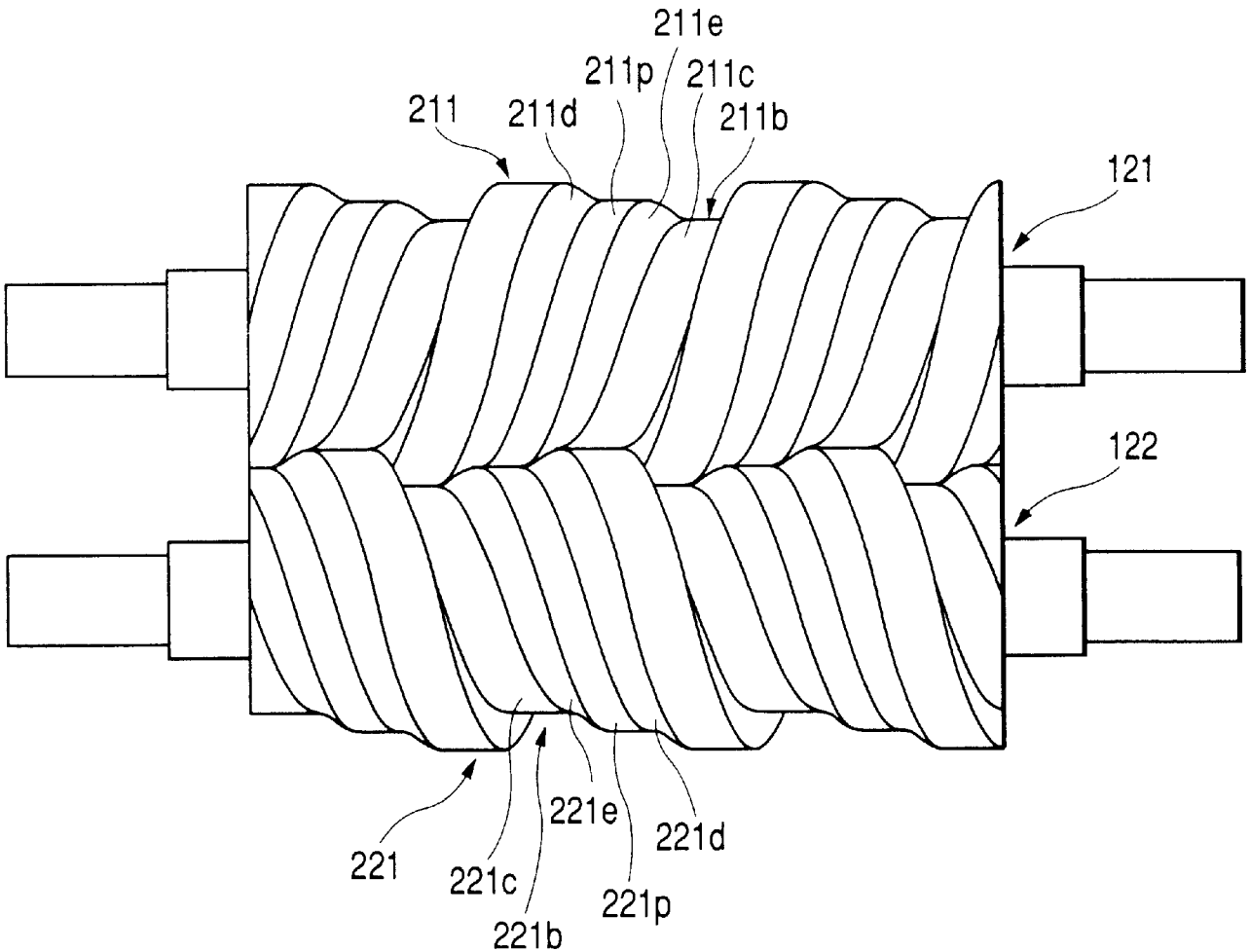
FIG. 7 is a front view showing the meshing relation between the male and female screw rotors according to another embodiment of the invention.
Figure 8A:
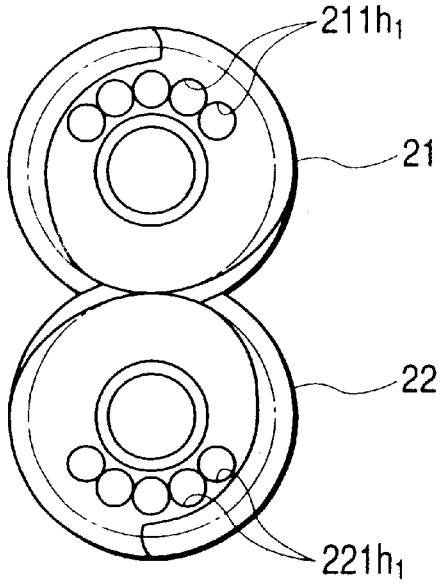
FIGS. 8(*a*) and 8(*b*) are views showing the shapes of the opposite ends of the male and female screw rotors according to another embodiment of the invention.
Figure 8B:
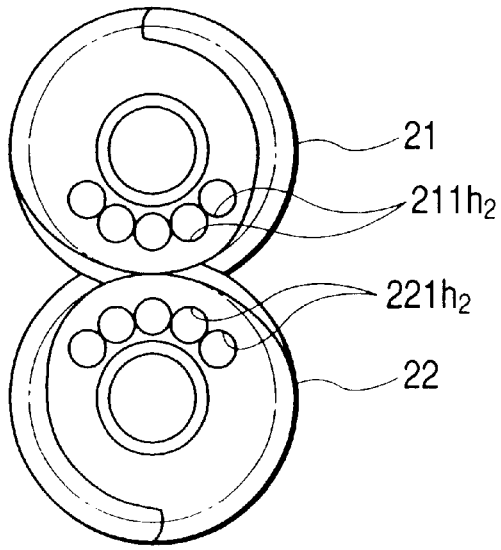

FIGS. 7 and 8 are the views showing the screw rotors according to another embodiment of the invention, and any other arrangement than that of the rotors of the screw machine is entirely similar to that of the aforesaid embodiment.

In each of the screw rotors 121, 122 of this embodiment, as in the aforesaid embodiment, the lead number is made integral to position the position of center of gravity in the whole rotor on the rotation center axis, and further the simple shallow concave portions for striking a couple balance are formed. That is, even if the position of center of gravity is positioned on the rotation center axis as a whole, upon considering the center of gravity which is spaced apart in the axial direction and eccentric in the reverse direction, the centrifugal force of the both portions causes a force couple, thereby deteriorating the lateral pressure balance of the bearings on the sides of the opposite ends, i.e., causing a force couple unbalance. In order to counterbalance such a force couple to strike a stable balance, in the screw rotors 121, 122 of this embodiment, a plurality of closed-end cylindrical concave portions 211*h*1, 211*h*2, 221*h*1, 221*h*2 opened on the axially opposite ends are formed with at least one arranged in a predetermined radial location, e.g., at a substantially constant depth. As a matter of course, the number, position, depth, etc. of the concave portion for adjusting the couple balance can be set accordingly. Any other arrangement than this is similar to that of the aforesaid embodiment.

Also in this embodiment, the similar advantage to the aforesaid embodiment can be attained. In addition, since the concave portions 211*h*1, 211*h*2, 221*h*1, 221*h*2 for the couple balance are each shaped as a concavity in a circular hole form with an identical diameter, the adjustment of the couple balance can be performed through a simple processing.

Further, in the aforesaid embodiment, the respective screw rotors are explained such that the flight leads thereof are equal from the suction side to the exhaust side. Alternatively, for example, a plurality of screw portions with different leads from each other may be provided so that the lead on the compressor side is smaller than that on the suction side, or the pitches between the screw teeth may become steplessly gradually smaller the nearer to the exhaust side. That is, it is possible to form the screw rotors with variable leads.

According to the invention, between the addendum surface portion and the deddendum surface portion of the screw tooth, there is provided the pitch circumference portion which forms a predetermined angle range of circular arc having a definite radius on an optional transverse cross section perpendicular to the rotation axis. Consequently, since the offset of a gravity center position of the rotor from the rotation center can be made small, there is no need to form the complex cavities by means of as cast etc. for striking a couple balance.

When the screw rotors undergo thermal expansion due to a continuous, high-speed operation etc., and the like case, the pitch circumference portions with a definite radius are initially abutted against each other into a rolling contact so that the both rotors are slidingly contacted, thereby enabling preventing the occurrence of seizure. Consequently, it is possible to solve the conventional problem that the meshing clearance between the screw rotors must be set to a large value for preventing seizure even at the sacrifice of exhaust performance.

What is claimed is:

1. A screw rotor that is provided, around a rotation axis, with a screw tooth having a spiral addendum surface portion and a deddendum surface portion forming a spiral groove between adjacent turns of the addendum surface portion, and that is to be used in combination with a mating screw rotor in reverse screw relation to form male and female pair, the screw rotor comprising:

a pitch circumference portion which is provided between said addendum surface portion and said deddendum surface portion and which forms circular arc extending in a predetermined angle range and having a constant radius on an arbitrary transverse cross section perpendicular to said rotation axis.

2. The screw rotor according to claim 1, wherein said pitch circumference portion is formed in a band shape in a radial location substantially at a midpoint between said addendum surface portion and said deddendum surface portion.

3. The screw rotor according to claim 1, wherein said radius of said pitch circumference portion is set such that, when said screw rotor is meshed with said mating screw rotor, a meshing clearance between said pitch circumference portions of said screw rotors meshed with each other is smaller than other meshing clearances between said screw rotors.

4. A screw machine comprising:

a pair of male and female rotors meshed with each other, each of said rotors being constructed by the screw rotor according to claim 1;

a housing forming a suction port and an exhaust port, and accommodating therein said rotors to extend in parallel to each other and to be meshed with each other in a non-contact meshing engagement state;

a plurality of operation chambers that are provided between said housing and said rotors, and that have volume increased in a transfer section communicating with said suction port, while decreased in a transfer section communicating with said exhaust port.

5. The screw machine according to claim 4, wherein fluid is transferred in an axial direction of said rotation axis by rotation of said screw rotors.

* * * * *